US010602801B2

(12) United States Patent
Silva

(10) Patent No.: US 10,602,801 B2
(45) **Date of Patent: *Mar. 31, 2020**

(54) ADJUSTABLE ARTICLE SYSTEM

(71) Applicant: COMPUGLOBALHYPERMEGANET LLC, Fair Haven, NJ (US)

(72) Inventor: Christopher Anthony Silva, Fair Haven, NJ (US)

(73) Assignee: COMPUGLOBALHYPERMEGANET LLC, Fair Haven, NJ (US)

( * ) Notice: Subject to any disclaimer, the term of this patent is extended or adjusted under 35 U.S.C. 154(b) by 352 days.

This patent is subject to a terminal disclaimer.

(21) Appl. No.: 15/221,309

(22) Filed: Jul. 27, 2016

(65) Prior Publication Data

US 2017/0215517 A1 Aug. 3, 2017

Related U.S. Application Data

(63) Continuation-in-part of application No. 15/009,357, filed on Jan. 28, 2016.

(51) Int. Cl.

| | |
|---|---|
| ***A43B 11/00*** | (2006.01) |
| ***A43C 11/00*** | (2006.01) |
| ***A43B 23/02*** | (2006.01) |
| ***A43B 7/14*** | (2006.01) |
| ***A43B 1/00*** | (2006.01) |

(52) U.S. Cl.

CPC ..... *A43B 11/00* (2013.01); *A43B 1/0018* (2013.01); *A43B 7/141* (2013.01); *A43B 7/1475* (2013.01); *A43B 23/0205* (2013.01); *A43B 23/0245* (2013.01); *A43C 11/008* (2013.01)

(58) Field of Classification Search

CPC ..... A43B 3/26; A43B 3/0078; A43B 7/14; A43B 23/0215; A43B 5/0427; A43B 5/1608; A43B 23/0285; A43B 23/029; A43B 23/028; A43B 11/00; A43B 23/027; A43B 3/0005; A43B 1/0018; A43C 11/00; A43C 11/002; A43C 11/004; A43C 11/006; A43C 11/008; A43C 11/22

USPC ..... 36/97, 93, 50.1, 51, 83, 119.1, 118.1, 36/50.5; 383/3, 118; 206/522

See application file for complete search history.

(56) References Cited

U.S. PATENT DOCUMENTS

| | | | | |
|---|---|---|---|---|
| 5,343,638 A * | 9/1994 | Legassie | ..... | A43B 3/0005 36/28 |
| 6,378,230 B1 | 4/2002 | Rotem et al. | | |
| 6,438,872 B1 * | 8/2002 | Chil | ..... | A43B 1/0072 36/102 |
| 6,990,755 B2 * | 1/2006 | Hatfield | ..... | A43B 3/0057 36/102 |
| 7,380,351 B1 * | 6/2008 | Pavone | ..... | A43B 1/0072 36/28 |

(Continued)

*Primary Examiner* — Anna K Kinsaul
*Assistant Examiner* — F Griffin Hall
(74) *Attorney, Agent, or Firm* — Porzio Bromberg & Newman P.C.

(57) ABSTRACT

The present invention is directed to an adjustable footwear system to provide varying degrees of tightness in different areas of the footwear before and after the footwear is received on the foot. An extensor system is activated to open or close a cavity of the footwear between the upper and an insole. The extensor system can provide loosen the footwear to the foot.

3 Claims, 17 Drawing Sheets

(56) References Cited

U.S. PATENT DOCUMENTS

| | | | | |
|---|---|---|---|---|
| 8,661,714 | B2 * | 3/2014 | Sussmann | A43B 3/24 36/102 |
| 8,769,844 | B2 | 7/2014 | Beers et al. | |
| 8,887,411 | B2 * | 11/2014 | Lacorazza | A43B 3/26 36/45 |
| 2010/0083535 | A1 * | 4/2010 | Meschter | A43B 7/1495 36/88 |
| 2011/0035963 | A1 * | 2/2011 | Baker | A43B 1/0018 36/114 |
| 2015/0013184 | A1 * | 1/2015 | Beers | A43C 11/004 36/83 |
| 2016/0249706 | A1 * | 9/2016 | Leary | A43B 7/1495 36/93 |
| 2016/0309834 | A1 * | 10/2016 | Zwick | A43B 5/025 |
| 2016/0331082 | A1 * | 11/2016 | Weidl | A43B 3/26 |
| 2016/0366978 | A1 * | 12/2016 | Holt | A43B 1/04 |
| 2017/0000210 | A1 * | 1/2017 | Bigolin | A43C 1/003 |

* cited by examiner

ADJUSTABLE ARTICLE SYSTEM

BACKGROUND OF THE INVENTION

Field of the Invention

The present invention relates in general to an adjusting system for an article and in particular to an adjustable footwear system in which the footwear is initially in a tightened state and can be loosened for insertion of a foot and subsequently adjusted after the insertion of the foot.

Description of Related Art

Conventional footwear typically is inherently loose in order for ease of insertion of the foot. The footwear includes a closing mechanism such as a type of lacing, buckle, ratchet or strap in order to close the loose section of the footwear to create a tight fit.

U.S. Pat. No. 8,769,844 describes an article of footwear including an automatic lacing system. The lacing system provides a set of straps that can be automatically opened and closed to switch between a loosened and a tightened position of the upper of the footwear.

It is desirable to provide an adjustable footwear system to loosen the footwear during insertion of the foot into the footwear and provide varying degrees of tightness in different areas of the footwear after the footwear is received on the foot.

SUMMARY OF THE INVENTION

The present invention provides an adjustable article system to provide varying degrees of tightness in different areas of an article. In particular, the article can be footwear. In one embodiment, the present invention is directed to an adjustable footwear system to provide varying degrees of tightness in different areas of the footwear before and after the footwear is received on the foot. The footwear is, in its initial form, tightest on the inner cavity with an upper comprised of one or more elastic materials. The footwear can also include more rigid materials in order to provide additional support or decoration.

The adjustable footwear system includes an extensor system for loosening and tightening the footwear. In particular, the extensor system is activated to create a rigid infra-structure to open a cavity of the footwear between the upper and an insole. The extensor system can be hydraulic and use fluids or air with a device to manually increase the pressure in the extensor system. In one embodiment, the device includes a crank and ratchet device or a pump. Pressure in the extensor system is increased in order to loosen the shoe. Alternatively, pressure in the extensor system is decreased in order to return the shoe to its tighter natural state. The extensor system can include single or multiple chambers within the footwear to allow for varying degrees of tightness in different areas of the footwear. In one embodiment, the extensor system includes one or more extensor arms which are positioned in any direction, or a plurality of directions, in the upper. In one embodiment, the a plurality of extensors are assembled to form a grid or mesh pattern throughout the entire upper.

In one embodiment, when the extensor system has zero pressure, the extensor arms in the upper are pliable, leaving the upper having elastic properties in its original, tightest state on the cavity between the upper and the sole assembly. As the user exerts pressure on the extensor system with the device, the extensor arms become more rigid and extend for expanding the volume of the inner cavity. Maximum and near maximum pressure conditions of the extensor system open the inner cavity sufficiently to allow for easy entry of the user's foot into the cavity. Once the foot is in the cavity, the user can decrease the pressure in the extensor system. The decrease of pressure in the extensor system decreases the cavity volume and allows for the elastic upper to apply pressure to the foot. The pressure in the extensor system is user adjustable to allow the user to determine how much force is exerted by the elastic upper on the foot. The extensor system can be placed on key areas of the foot to provide an easy opening and a snug fit for support when walking.

In one embodiment, the extensor system can be applied to a wedge type shoe including ankle and heel support. An elastic wrapping can be provided at the top of the foot for providing a snug fit to the foot. Alternatively, the extensor system can be included in a low top or a climbing shoe.

The extensor system can be pressure activated. The extensor system can include a path for coupling one or more heel extensors and one or more upper extensors to a fluid reservoir. A pressure button actuator can be used to increase or reduce pressure in the extensor system. In one embodiment, the fluid reservoir is positioned within the sole. In an alternate embodiment, the fluid reservoir is positioned in a pressure activation device housing including the pressure button actuator.

The one or more heel extensors and the one or more upper extensors can be formed individually or a as a plenum which is divided by one or more baffles. The one or more heel extensors and the one or more upper extensors can be positioned in a side of the footwear. Alternatively the one or more heel extensors extend radially around a heel portion of the footwear and the one or more upper extensors extend radially around an upper portion of the footwear The present invention can be applied to all types of footwear including, but not limited to, athletic shoes, athletic cleats, formal shoes, ski boots, snowboard boots, and standard boots. The present invention can be used as an inner liner for an outer shoe.

In one embodiment, the article can be other wearable items which require a desired fit such as, but not limited to, watch bands, headwear, compression clothing, and durable medical equipment, including medical braces.

The invention will be more fully described by reference to the following drawings.

DETAILED DESCRIPTION

Figure 1:
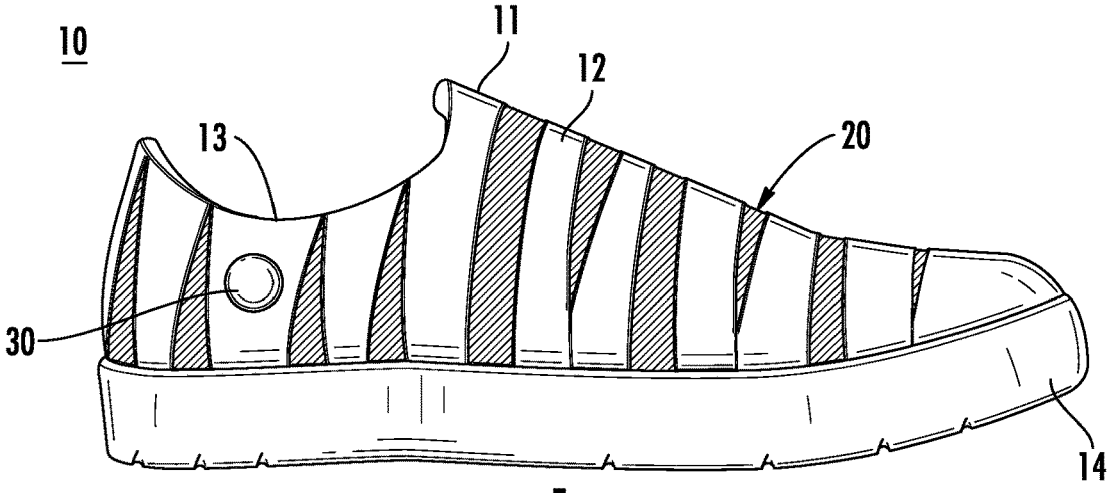
FIG. 1 is a schematic diagram of a side view of the adjustable footwear system in accordance with the teachings of the present invention in an un-activated state.

Reference will now be made in greater detail to a preferred embodiment of the invention, an example of which is illustrated in the accompanying drawings. Wherever possible, the same reference numerals will be used throughout the drawings and the description to refer to the same or like parts.

Figure 2:
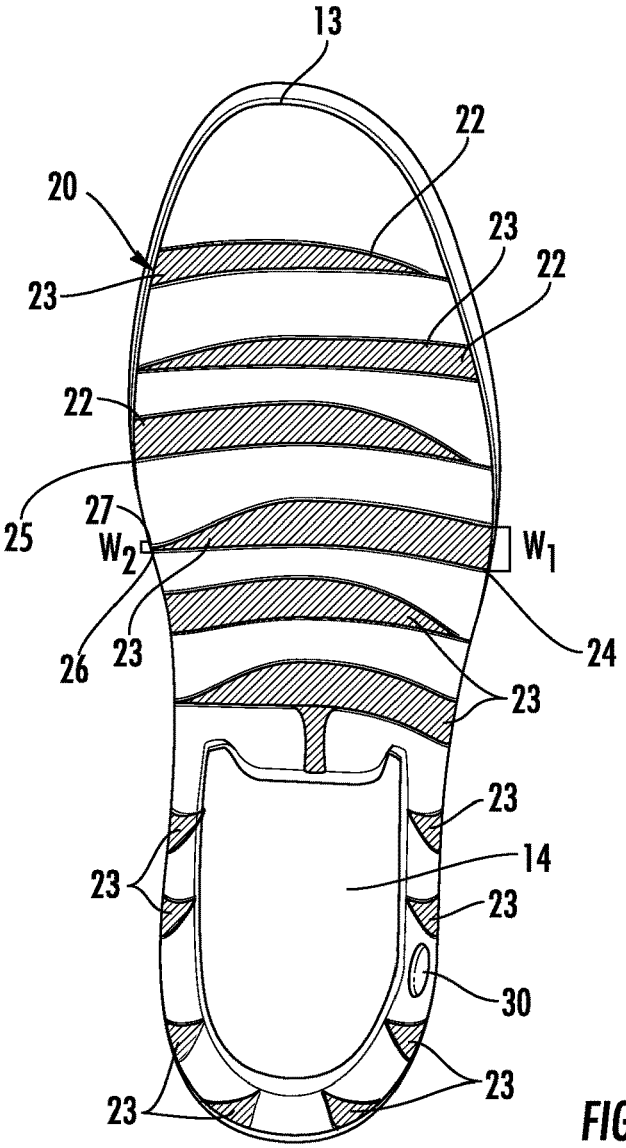
FIG. 2 is a top plan view of the adjustable footwear system shown in FIG. 1.

FIGS. 1 and 2 are schematic diagrams of adjustable footwear system 10 in accordance with the teachings of the present invention. Adjustable footwear system 10 is shown in an un-activated state. Footwear 11 includes upper 12. Preferably, upper 12 is formed of an elastic material. For example, upper 12 can be formed of one or more materials having elastic properties. Suitable materials include, but are not limited to, Lycra, elastic, spandex, neoprene, or PVC. Upper 12 can also include one or more materials which are more rigid. Suitable rigid materials include, but are not limited to, plastic, polyurethane and polypropylene. The rigid material can provide support of upper 12 or decoration. Cavity 13 is formed between upper 12 and insole 14.

Adjustable footwear system 10 includes extensor system 20. Extensor system 20 can be activated by pressure activation device 30 to provide a rigid infra-structure. Extensor system 20 includes a one or more extensors 22. In this embodiment, extensors 22 are formed of extensor arms 23. Extensor arms 23 can be positioned to extend from one side 24 of upper 12 to the other side 25 of upper 12. Width $W_1$ adjacent of respective extensor arms 23 positioned adjacent side 24 or side 25 can be greater than width $W_2$ at end 26 of extensor arms 23. Extensor arms 23 can extend from width $W_2$ to point 27.

Extensors 22 are coupled to pressure activation device 30. Pressure activation device 30 controls pressure within extensors 22. In the un-activated state shown in FIG. 1 and FIG. 2 zero pressure is used in extensor system 20. Extensor arms 23 in the un-activated state are substantially flat within upper 12.

Figure 3:
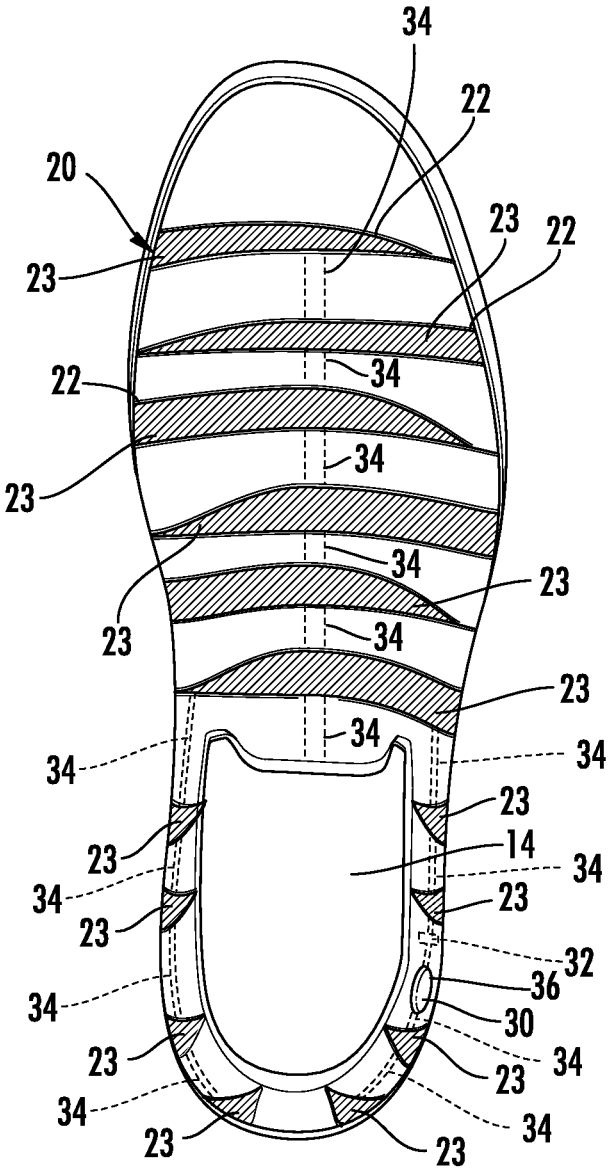
FIG. 3 is a schematic diagram of an extensor system and a pressure activation device which can be used in the adjustable footwear system.

Pressure activation device 30 can be hydraulic and use fluids or air with device 32 to manually increase the pressure in extensor system 20 as shown in FIG. 3. Coupling lines 34 can be used to couple device 32 to pressure button actuator 36. Device 32 can be a pump. Alternatively, device 32 can be a crank and ratchet device or a battery powered device to regulate the desired pressure.

Figure 4:
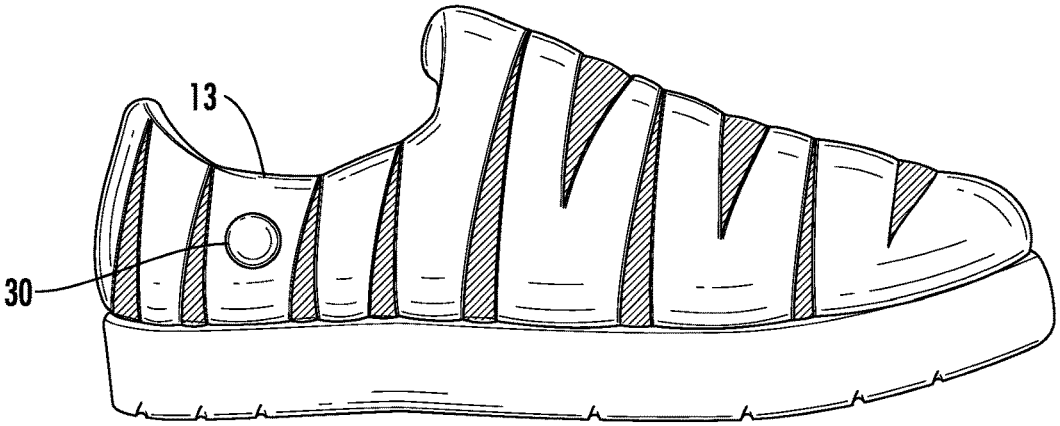
FIG. 4 is a schematic diagram of a side view of the adjustable footwear system in an activated state.
Figure 5:
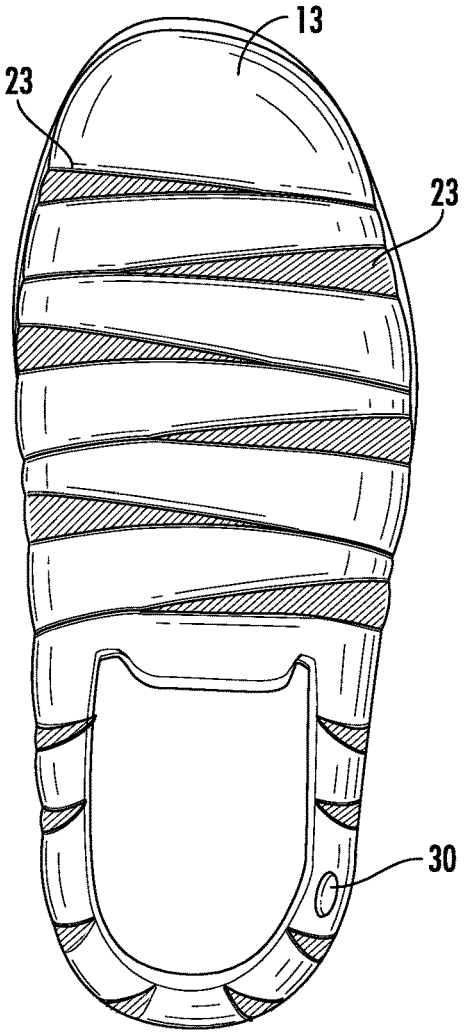
FIG. 5 is a top plan view of the adjustable footwear system shown in FIG. 4.

Activation of pressure button actuator 36 increases pressure in extensor system 20 to increase rigidity of extensor system 20. Referring to FIGS. 4 and 5, in one embodiment, increasing of pressure in extensor system 20 extends extensor arms 23 in a substantially vertical direction to extend upper 12 away from insole 14 thereby increasing the size of cavity 13. In the activated state extensor arms 23 are no longer flat.

Figure 6:
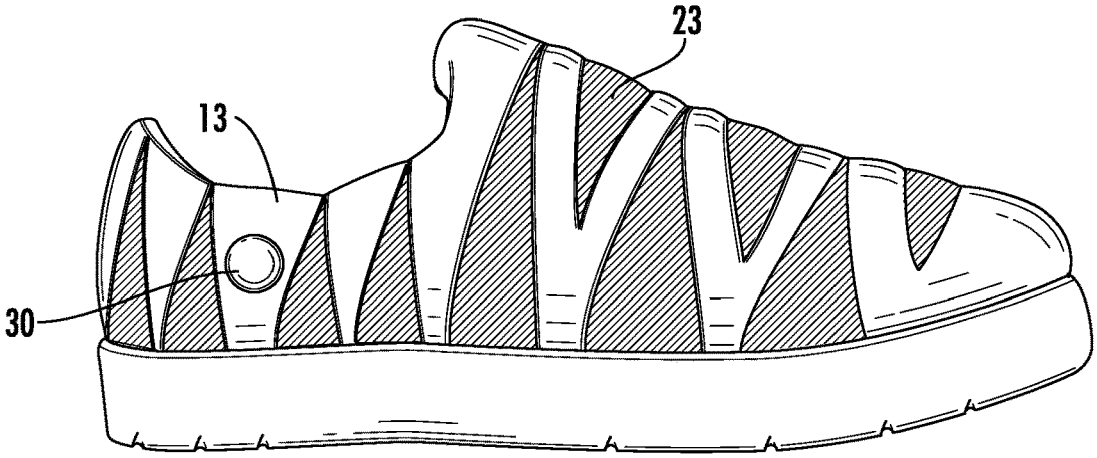
FIG. 6 is a schematic diagram of a side view of an alternative adjustable footwear system in an activated state.
Figure 7:
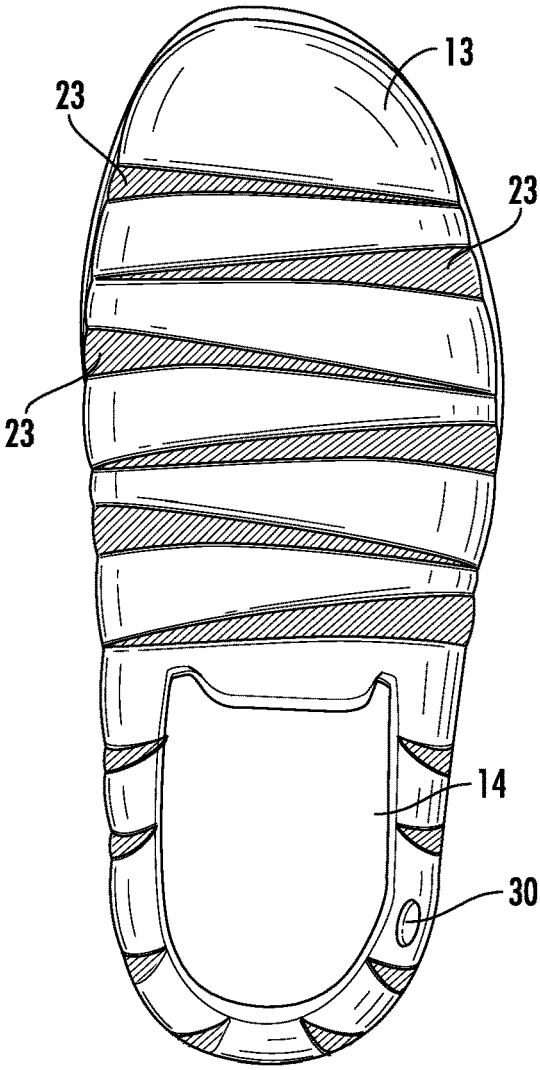
FIG. 7 is a top plan view of the adjustable footwear system shown in FIG. 6.

Referring to FIGS. 6 and 7, in one embodiment, extensor arms 23 expand in both a horizontal and vertical direction to extend upper 12 away from insole 14 thereby increasing the size of cavity 13. In the activated state extensor arms 23 are no longer flat.

Figure 8:
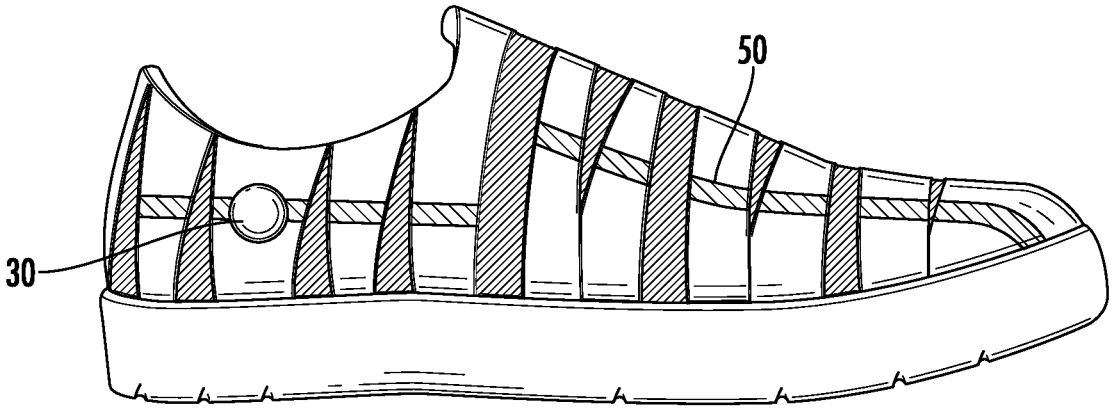
FIG. 8 is a schematic diagram of a side view of an alternative adjustable footwear system in an un-activated state.
Figure 9:
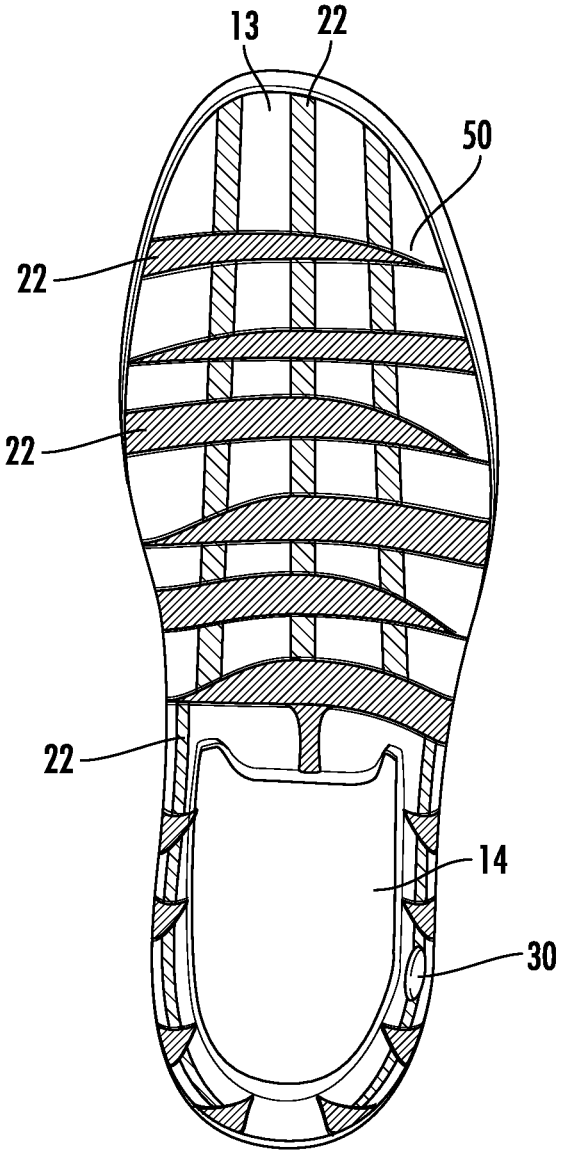
FIG. 9 is a top plan view of the adjustable footwear system shown in FIG. 8.
Figure 10:
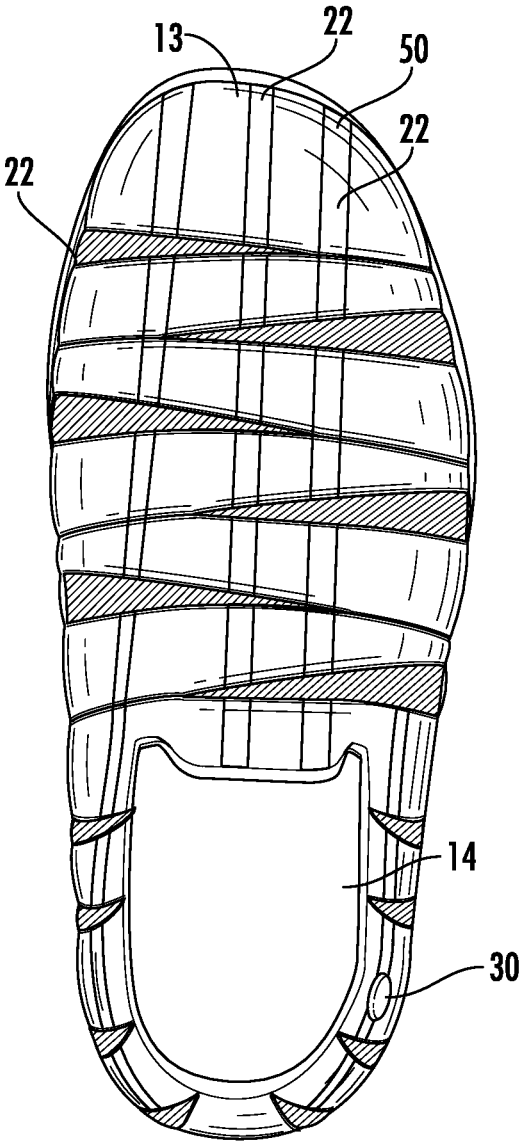
FIG. 10 is a top plan view of the adjustable footwear system shown in FIG. 8 in an activated state.

Referring to FIGS. 8 and 9, in one embodiment, extensor system 20 includes extensor mesh 50 formed of overlapping extensors 22. Pressure activation device 30 can be activated for increasing of pressure to extends mesh 50 away from insole 14 thereby increasing the size of cavity 13 as shown in FIG. 10.

Figure 11:
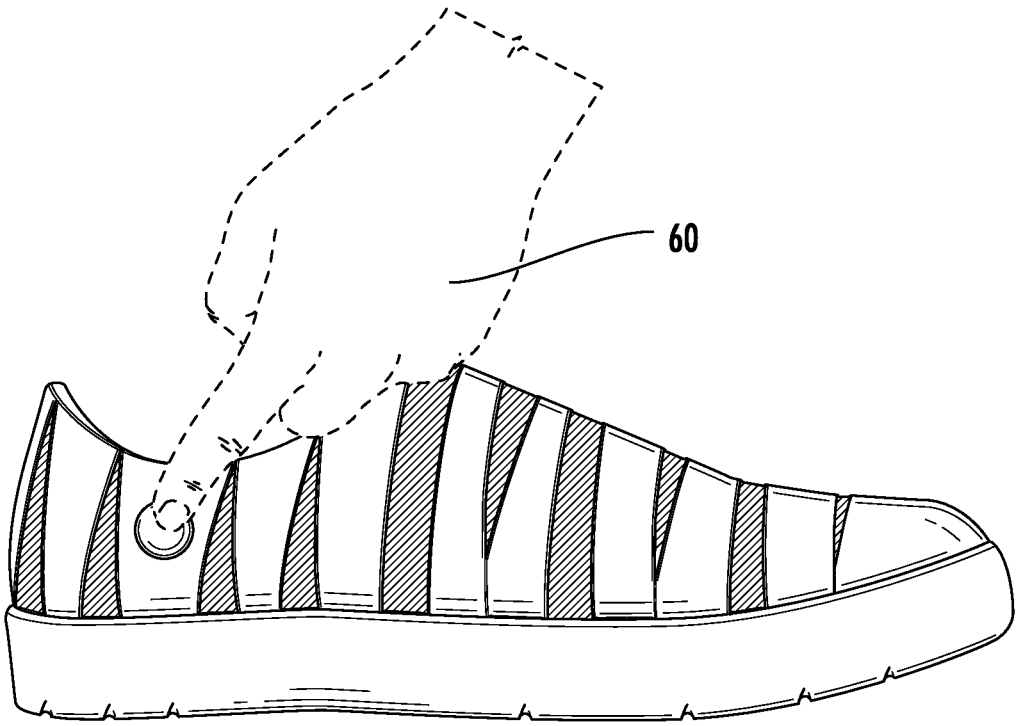
FIG. 11 is a side view of activation of the adjustable footwear system.
Figure 12:
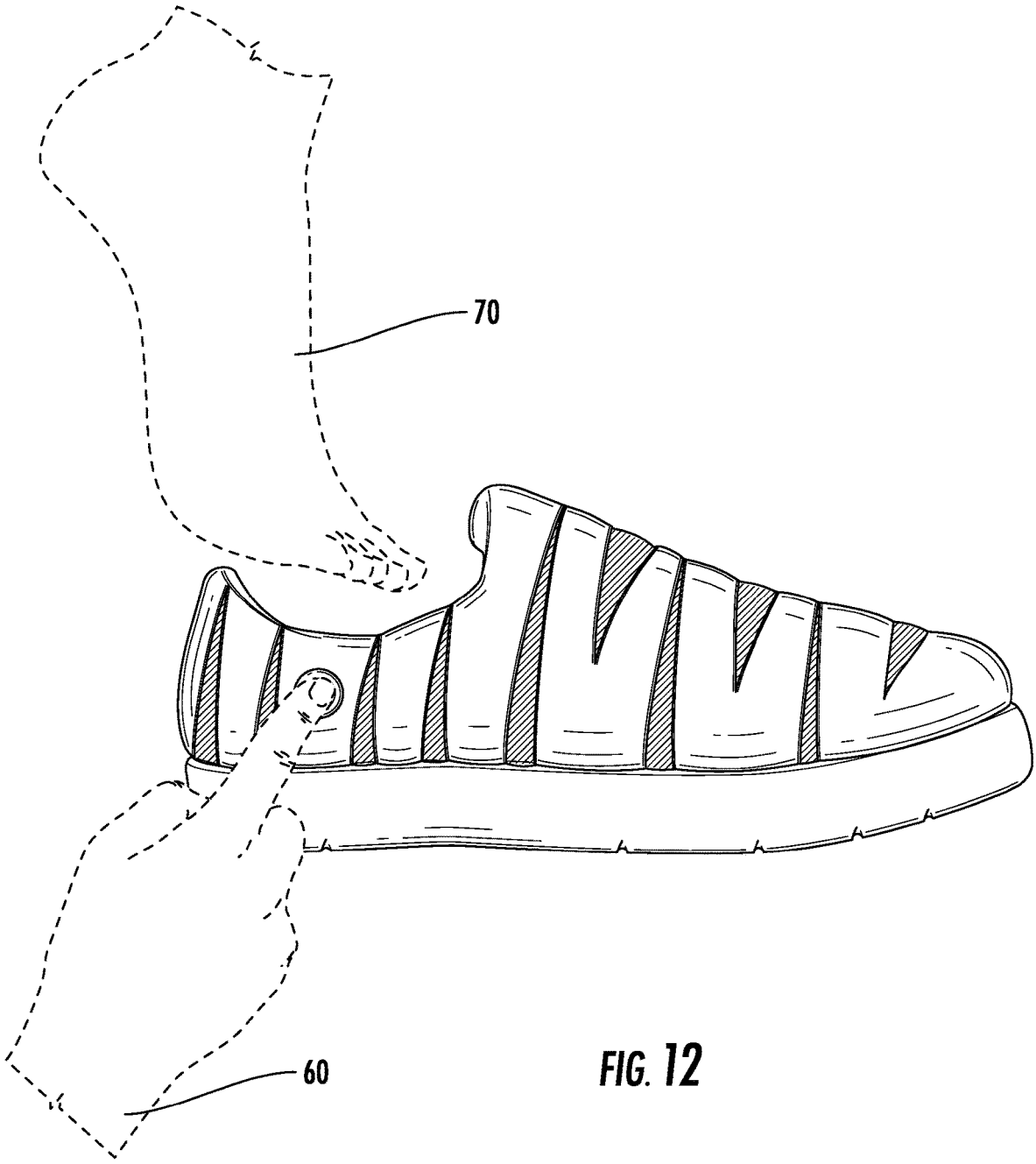
FIG. 12 is a side view of use of the adjustable footwear system after activation.

Activation of pressure button actuator 36 by finger 60 of a user can increase pressure in extensor system 20 to a maximum pressure to expand cavity 13 to its largest volume and allow for easy entry of foot 70 into cavity 13, as shown in FIGS. 11 and 12. Once foot 70 is in cavity 13, finger 60 of the user can activate pressure button actuator 36 to decrease pressure in extension system 20, which decreases volume of cavity 13, and allows for the elastic upper 13 to apply the pressure on foot 70.

Figure 13:
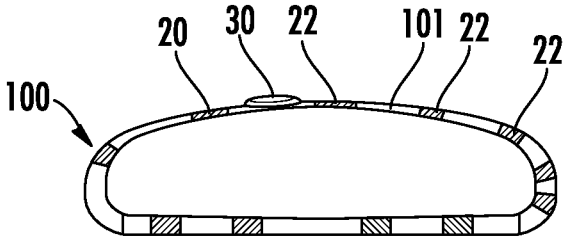
FIG. 13 is a schematic diagram of a side view of the adjustable article system in accordance with the teachings of the present invention in an un-activated state.
Figure 14:
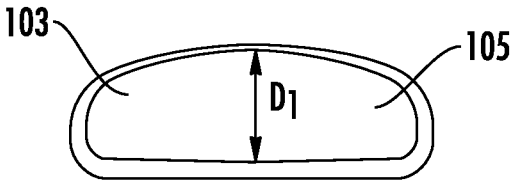
FIG. 14 is a top plan view of the adjustable article system shown in FIG. 11 in an un-activated state.
Figure 15:
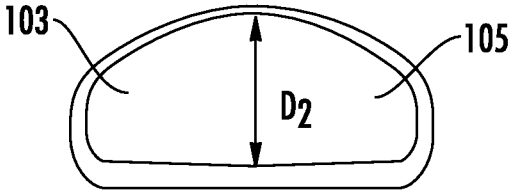
FIG. 15 is a top plan view of the adjustable article system shown in FIG. 11 in an activated state.

FIGS. 13-15 are schematic diagrams of adjustable article system 100 in accordance with the teachings of the present invention. Article 101 can be for example a band or a sleeve such as a watch band, headband or medical band. Adjustable article system 100 is shown in an un-activated state in FIGS. 13 and 14. Article 101 has diameter $D_1$ between sides 103. Article 101 includes embedded extensor system 20 and pressure activation device 30. Extensor system 20 can be activated by pressure activation device 30 to provide a rigid infra-structure. In the activated state shown in FIG. 15, diameter $D_2$ is increased from diameter $D_1$ to enlarge opening 105.

Figure 16:
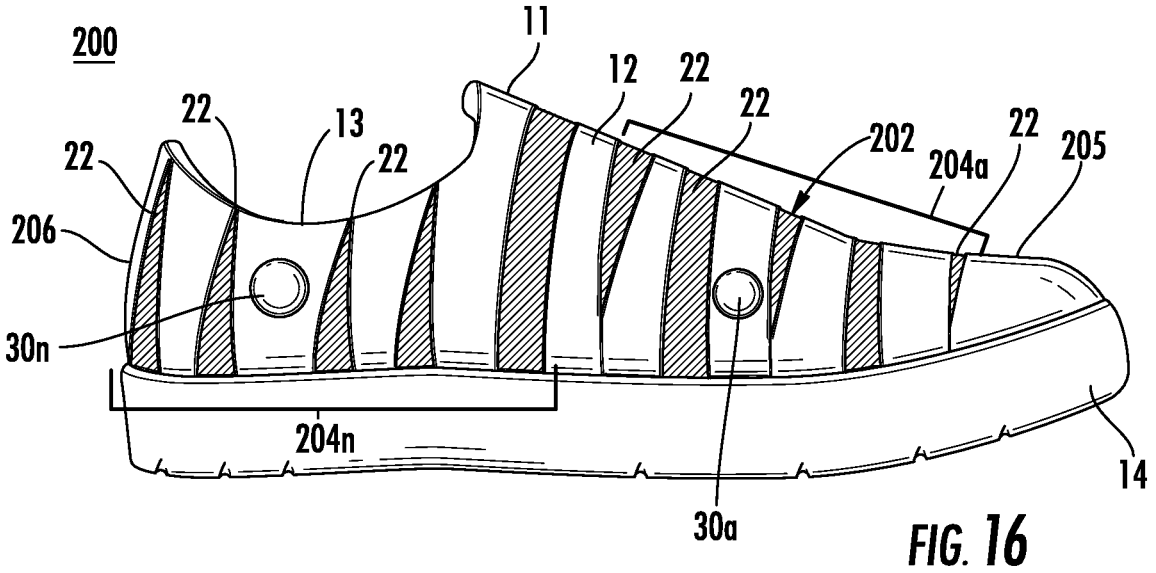
FIG. 16 is a schematic diagram of an extensor system and a plurality of pressure activation devices which can be used in an adjustable footwear system.
Figure 17:
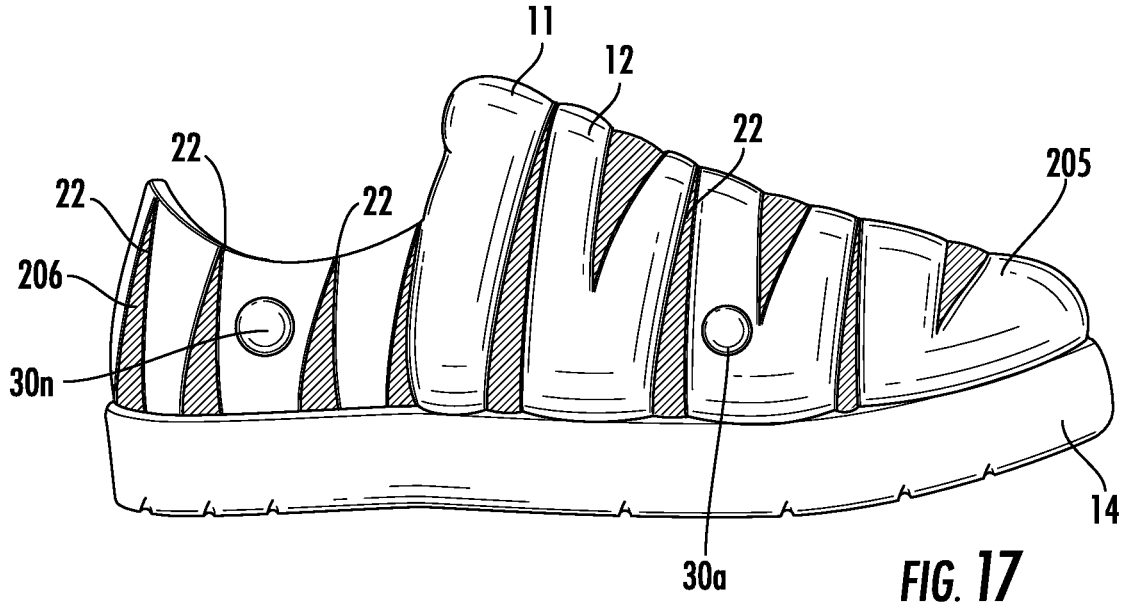
FIG. 17 is a schematic diagram of the extensor system and a plurality of pressure activation devices which can be used in an adjustable footwear system of FIG. 16 in an activated state.

FIG. 16 is a schematic diagram of adjustable footwear system 200 which includes extensor system 202. Extensor system 202 includes first group 204*a* of extensors 22 positioned at front 205 of footwear 11 and second group 204*n* of extensors 22 positioned at rear 206 of footwear 11. Extensors 22 of first group 204*a* can be activated by pressure activation device 30*a* to provide a rigid infra-structure. Extensors 22 of second group 204*n* can be activated by pressure activation device 30*n* to provide a rigid infra-structure. In the embodiment shown in FIG. 17, pressure activation device 30*a* is activated to activate first group 204*a* of extensors 22. It will be appreciated that any number of groups of extensors can be positioned in footwear and activated by a corresponding number of pressure activation devices to control pressure in different positions of the footwear.

Figure 18:
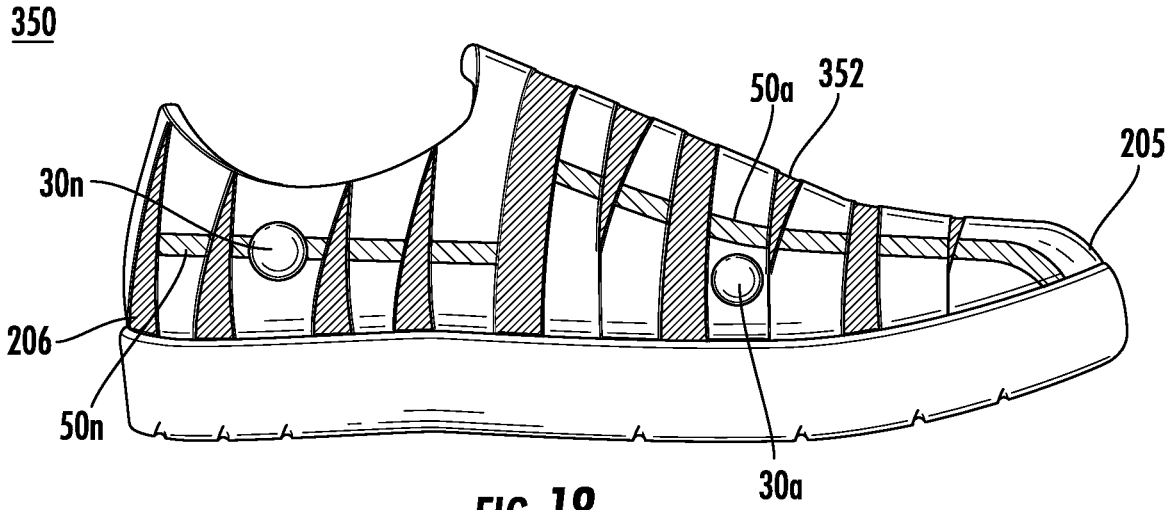
FIG. 18 is a schematic diagram of an extensor system and a plurality of pressure activation devices which can be used in an adjustable article system.
Figure 19:
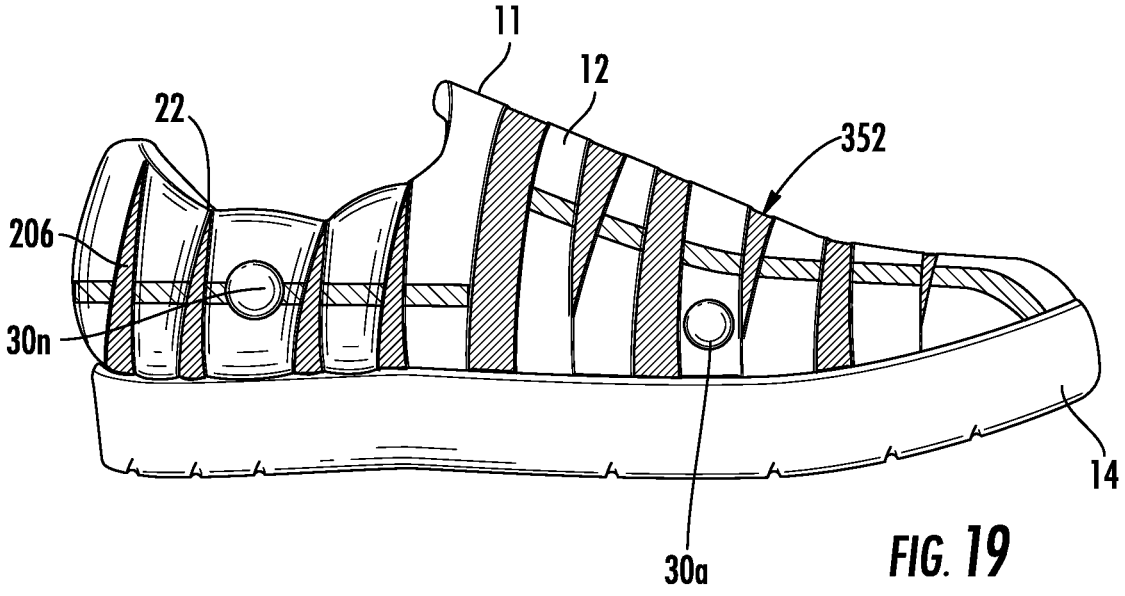
FIG. 19 is a schematic diagram of an extensor system and a plurality of pressure activation devices which can be used in an adjustable article system of FIG. 18 in an activated state.

FIG. 18 is a schematic diagram of adjustable footwear system 350 which includes extensor system 352. Extensor system 352 includes first mesh 50*a* positioned at front 205 of footwear 11 and second mesh 50*n* positioned at rear 206 of footwear 11. First mesh 50*a* can be activated by pressure activation device 30*a* to provide a rigid infra-structure. Second mesh 50*n* can be activated by pressure activation device 30*n* to provide a rigid infra-structure. In the embodiment shown in FIG. 19, pressure activation device 30*b* is activated to activate second mesh 50*n*. It will be appreciated that any number of portions of mesh can be positioned in footwear and activated by a corresponding number of pressure activation devices to control pressure in different positions of the footwear.

Figure 20:
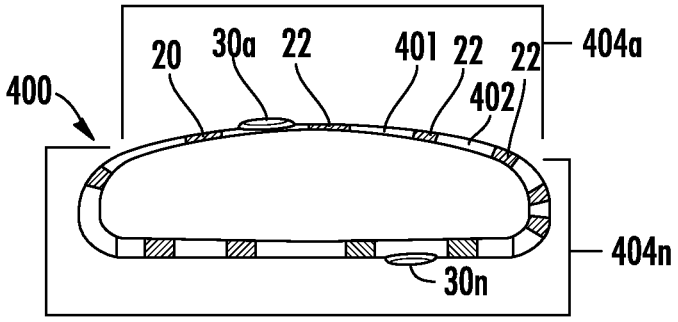
FIG. 20 is a schematic diagram of an extensor system and a plurality of pressure activation devices which can be used in an adjustable article system.

FIG. 20 is a schematic diagram of adjustable article system 400 includes embedded extensor system 402. Extensor system 402 includes first group 404*a* of extensors 22 positioned at side 405 of article 401 and second group 404*n* of extensors 22 positioned at side 406 of article 401. Extensors 22 of first group 404*a* can be activated by pressure activation device 30*a* to provide a rigid infra-structure. Extensors 22 of second group 404*n* can be activated by pressure activation device 30*n* to provide a rigid infra-structure.

Figure 21:
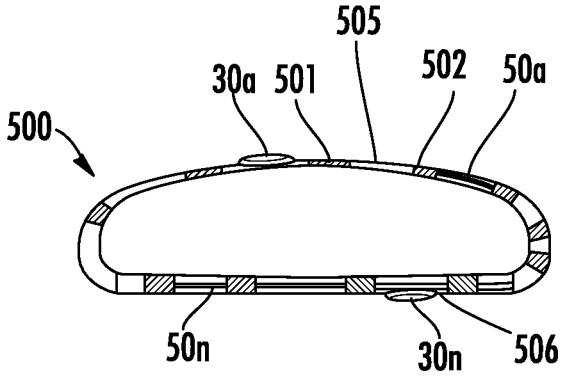
FIG. 21 is a schematic diagram of an extensor system and a plurality of pressure activation devices which can be used in an adjustable article system of FIG. 20 in an activated state.

FIG. 21 is a schematic diagram of adjustable article system 500 which includes extensor system 502. Extensor system 502 includes first mesh 50*a* positioned at side 505 of article 501 and second mesh 50*n* positioned at side 506 of article 501. First mesh 50*a* can be activated by pressure activation device 30*a* to provide a rigid infra-structure. Second mesh 50*n* can be activated by pressure activation device 30*n* to provide a rigid infra-structure. It will be appreciated that any number of groups of extensors can be positioned in the article and activated by a corresponding number of pressure activation devices to control pressure in different positions of the article. Alternatively, mesh 50*a* and mesh 50*n* can be formed in a spiral configuration.

Figure 22:
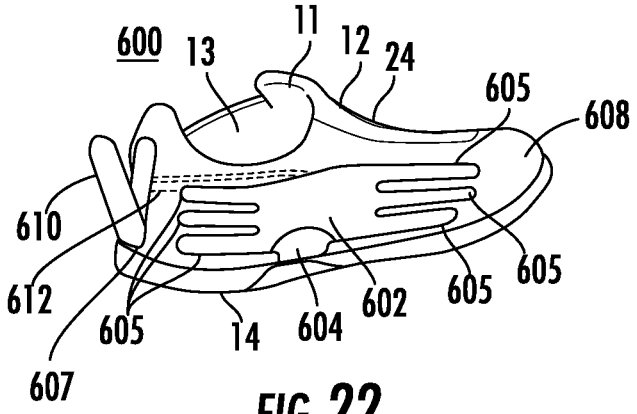
FIG. 22 is a schematic diagram of a side view of an adjustable footwear system including an extensor system in accordance with the teachings of the present invention.

FIG. 22 is a schematic diagram of adjustable article system 600 which includes extensor system 602. Extensor system 602 can be activated by device lever 610 to provide a rigid infra-structure. Extensor system 602 can be in the form of a flexible clip. Extensor system 602 includes extensor base 604. One or more extensor arms 605 can extend from extensor base 604. Extensor system 602 can be positioned within sides 24 of upper 12 from end 607 to end 608. Device lever 610 can be moved to squeeze extensor system 602 to enlarge cavity 13 to open upper 12. Device lever 610 can be locked in place. Device lever 610 can be moved again to release extensor system 602 to provide a rigid infra-structure and reduce cavity 13 and upper 12 creating a snug fit around a foot inserted into cavity 13. It will be appreciated that any number of groups of extensors can be positioned in the article and activated by a corresponding to control pressure in different positions of the article.

Figure 23A:
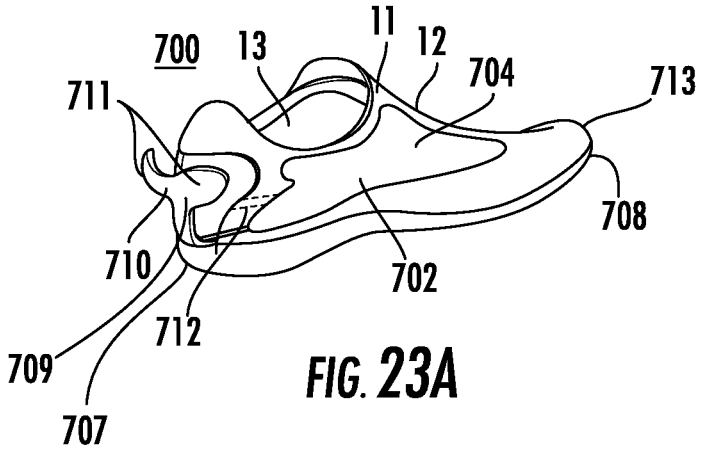
FIG. 23A is a schematic diagram of a side view of an adjustable footwear system including an extensor system in accordance with the teachings of the present invention.
Figure 23B:
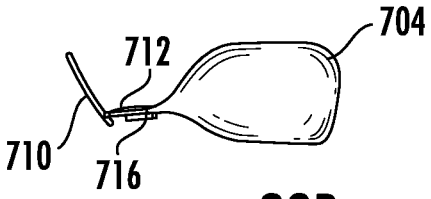
FIG. 23B is a schematic diagram of an air chamber used in the extensor system of FIG. 23A.

FIG. 23A is a schematic diagram of adjustable article system 700 which includes extensor system 702. Extensor system 702 can be activated by pressure activation device 708. Pressure activation device 708 can include device lever 710 device lever 710 to provide a rigid infra-structure. Device lever 710 can include arms 711 extending from central portion 709. Arms 711 can be grasped by a user to activate device lever 710. Extensor system 702 includes air chamber 704. Air chamber 704 is connected to device lever 710 with connection 712 as shown in FIG. 23B. Referring to FIG. 23A, Extensor system 702 can be positioned within side 24 of upper 12 from end 707 to end 713. Device lever 710 can be activated to create a vacuum within air chamber 704 to provide a rigid infra-structure and reduce cavity 13 and upper 12. Device lever 710 can be locked in place. Device lever 710 can be moved again to activate air valve 716 of extensor system 702 to inflate upper 12 creating a larger opening of cavity 13. It will be appreciated that any number of groups of extensors can be positioned in the article and activated by a corresponding to control pressure in different positions of the article.

Figure 25A:
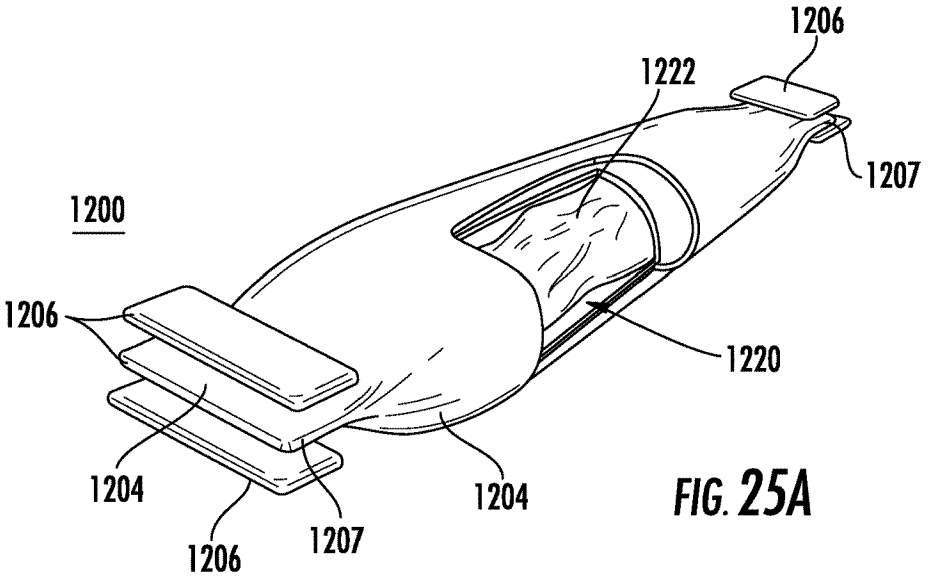
FIG. 25A is a schematic diagram the extensor system used in FIG. 24.
Figure 24:
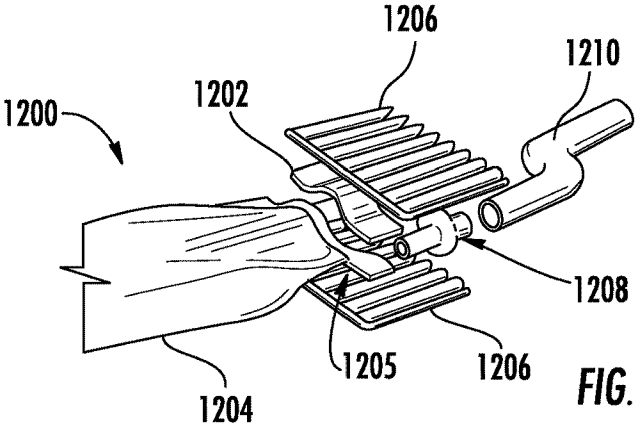
FIG. 24 is a schematic diagram of an extensor system and a pressure activation device of an adjustable footwear system.

FIGS. 24 and 25A-C are schematic diagrams of adjustable article system 1200 which includes extensor system 1202. Extensor system 1202 includes extensor chamber 1204. Extensor chamber 1204 can be a hydraulic extensor chamber. Chamber bracket 1205 is attached to one or more ends 1207 as shown in FIG. 25A. Panel 1206 can be attached to chamber bracket 1205. Panel 1206 can be formed of fabric. Hydraulic path connector 1208 connects extensor chamber 1204 to hydraulic path 1210 as shown in FIG. 24. Hydraulic path connector 1208 can receive hydraulic fluid 1210.

Hydraulic fluid 1210 can include for example water or air. Extensor material 1220 houses extensor chamber 1204.

Figure 25B:
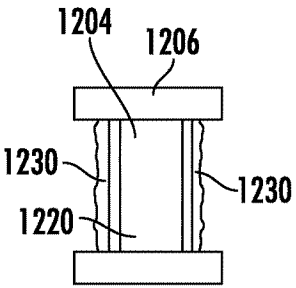
FIG. 25B is a schematic diagram of an extensor chamber which can be used in the extensor system shown in FIG. 25A.
Figure 25C:
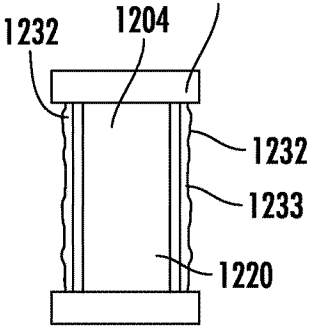
FIG. 25C is a schematic diagram of an extensor chamber which can be used in the extensor system shown in FIG. 25A.

In one embodiment, extensor material 1220 is includes edge 1230 as shown in FIG. 25B. Edge 1230 is substantially straight. In an alternate embodiment, extensor material 1220 includes edge 1232. Edge 1232 includes one or more curvatures 1233 as shown in FIG. 25C. Edge 1232 is substantially curved.

Figure 26D:
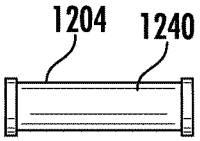
FIG. 26D is a schematic diagram of an extensor system.
Figure 26C:
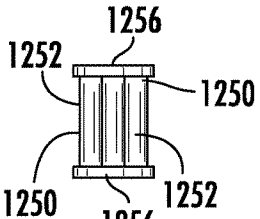
FIG. 26C is a schematic diagram of an extensor system.
Figure 26B:
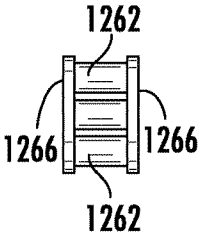
FIG. 26B is a schematic diagram of an extensor system.
Figure 26A:
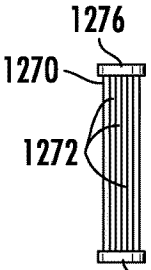
FIG. 26A is a schematic diagram of an extensor system.

FIGS. 26A-26D are schematic diagrams of variations of extensor system 1202 to provide an array of functions for various shoe types or activities. Extensor system 1240 includes extensor chamber 1204 having extensor material 1220 formed into cylindrical body 1242 as shown in FIG. 26A.

Extensor system 1250 includes a plurality of extensor chambers 1252 as shown in FIG. 26B. Extensor chambers 1252 extend longitudinally between panels 1256. Extensor chambers 1252 are substantially adjacent to one another. Extensor chambers 1252 can extend vertically within an adjustable article. Extensor chambers 1252 have a width which can vary with the application.

Figure 30A:
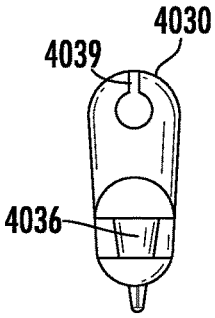
FIG. 30A is a perspective view of a pressure activation device used with the extensor system of FIG. 29B.
Figure 30B:
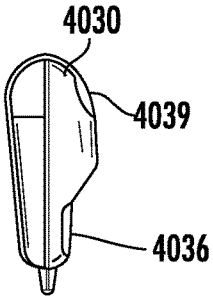
FIG. 30B is a front view of a pressure activation device used with the extensor system of FIG. 29B.

Extensor system 1260 includes a plurality of extensor chambers 1262 as shown in FIG. 30C. Extensor chambers 1262 extend laterally between panels 1266. Extensor chambers 1262 have space 1264 between one another. Extensor chambers 1262 can extend horizontally within an adjustable article.

Extensor system 1270 includes a plurality of extensor chambers 1272 as shown in FIG. 26D. Extensor chambers 1272 extend longitudinally between panels 1276. Extensor chambers 1272 are substantially adjacent to on to one another. Extensor chambers 1252 can extend vertically within an adjustable article. Extensor chambers 1272 have a width which can vary with the application.

Figure 27A:
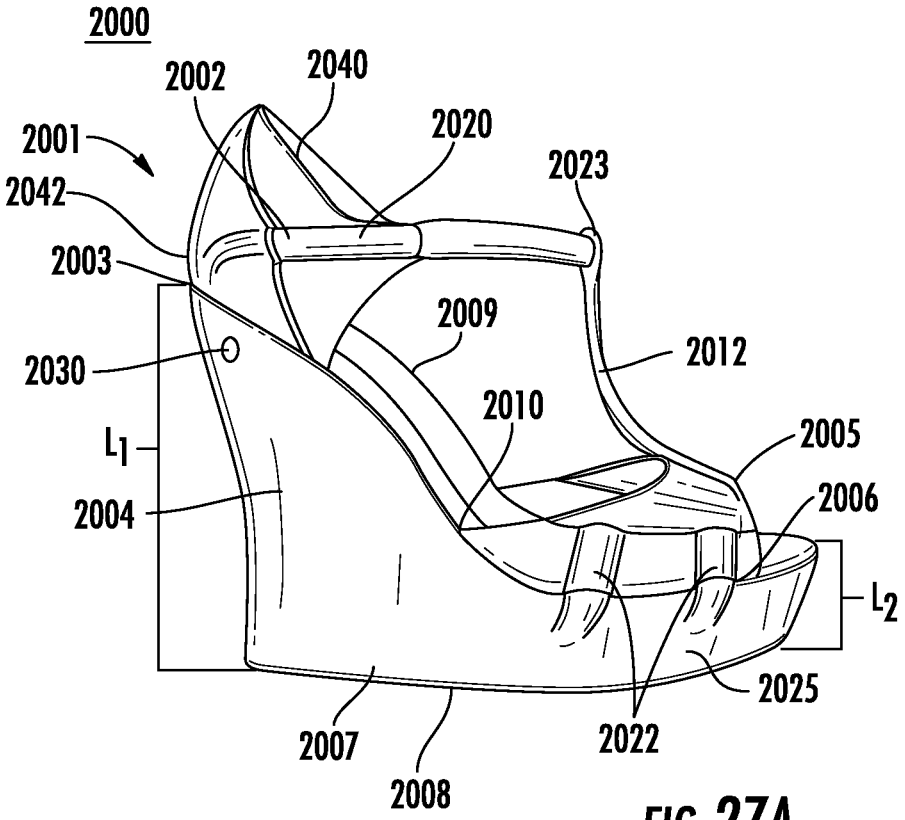
FIG. 27A is a schematic diagram of an extensor system used in an adjustable footwear system of a wedge.
Figure 27B:
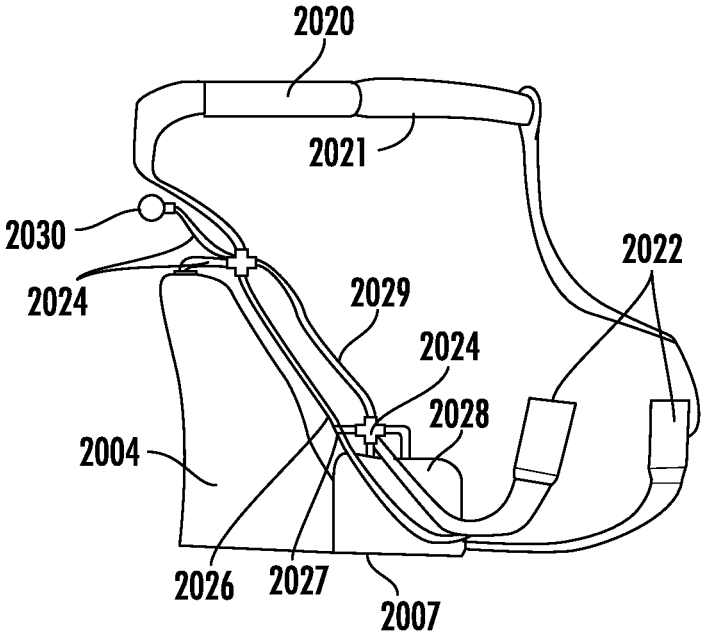
FIG. 27B is a schematic diagram of the extensor system used in FIG. 27A.

FIGS. 27A and 27B are schematic diagrams of adjustable footwear system 2000 in accordance with the teachings of the present invention. Adjustable footwear system 2000 includes extensor system is shown in an un-activated state. Footwear 2001 includes heel upper 2002 coupled to heel component compartment 2004 at upper portion 2003 of heel upper 2002. Toe upper 2005 is coupled to heel component compartment 2004 at lower portion 2006 of component compartment. Sole 2007 is positioned at bottom 2008 of compartment 2004. Insole 2009 is positioned at top 2010 of heel component compartment 2004. Heel component compartment 2004 can be in the shape of a wedge with length $L_1$ which is greater than length $L_2$.

Adjustable footwear system 2000 includes extensor system 2020. Extensor system 2020 can be coupled to heel upper 2002. Strap 2012 connects end 2023 of extensor system 2020 to toe upper 2005. Heel upper 2002, strap 2012 and toe upper 2005 can be formed of an elastic material. Suitable materials include, but are not limited to, Lycra, elastic, spandex, neoprene, or PVC. Extensor system 2020 can be activated by pressure activation device 2030 to enlarge one or more openings between heel upper 2002, strap 2012 and toe upper 2005 and insole 2009 of footwear 2001 for easy insertion of a foot.

Extensor system 2020 includes upper extensor 2021 and one or more lower extensors 2022. Upper extensor 2021 is attached to either side 2009 of heel upper 2002. Upper extensor 2021 is coupled with hydraulic path 2022 to path connector 2024.

One or more lower extensors 2022 are positioned in lower portion 2025 of heel component compartment 2004. One or more lower extensors 2022 are connected with hydraulic path 2026 to path connector 2024. Fluid reservoir 2028 is connected by hydraulic path 2027 to hydraulic path 2026. Hydraulic path connector 2029 connects path connector 2024 to pressure activation device 2030. Pressure activation device 2030 controls pressure within upper extensor 2021 and one or more lower extensors 2022. In the un-activated state shown in FIG. 27A zero pressure is used in extensor system 2020. Upper extensor 2021 and one or more lower extensors 2022 in the un-activated state are substantially flat. Pressure activation device 2030 can be hydraulic and use fluids or air with device 2032 to manually increase the pressure in extensor system 2030. Upper extensor 2021 in the activated state provides an easy opening between upper extensor 2021 and heel upper 2002 for receiving a foot. After insertion of the foot, upper extensor 2021 can be un-activated to provide a snug fit of heel upper 2002, strap 2012 and the foot. Lower extensors 2022 in the activated state provides an easy opening between lower extensor 2022 and toe upper 2005 for receiving a foot. After insertion of the foot, lower extensors 2022 can be un-activated to provide a snug fit of toe upper 2005 and the foot.

One or more upper flexors 2040 can be positioned at sides 2042 of heel upper 2002. Upper flexor 2040 is an elastic material. Suitable materials include, but are not limited to, Lycra, elastic, spandex, neoprene, or PVC. The one or more upper flexors 2040 can be used to pull strap 2012, upper extensors 2021 and toe upper 2005 for a tight fit of adjustable footwear system 2000. Activation of upper extensor 2021 and lower extensor 2022 creates sufficient force when extended under pressure to create a stronger counter force against upper flexor 2040 to open the cavity of footwear 2001 between heel upper 2002 and strap 2012. After insertion of the foot, upper flexor 2040 can be un-activated to provide a snug fit of upper flexor 2040 and the foot.

Figure 28A:
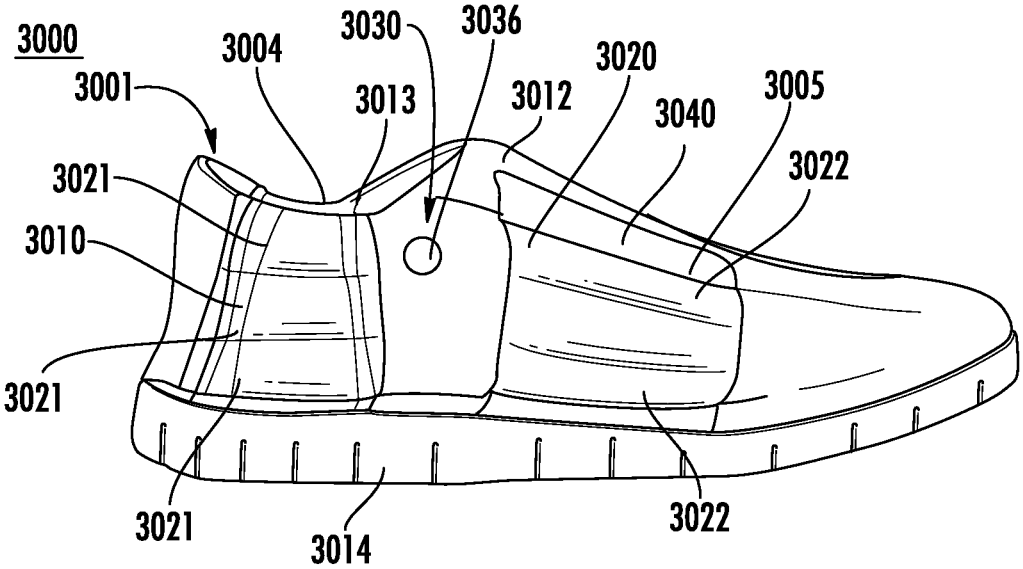
FIG. 28A is a schematic diagram of an extensor system used in an adjustable footwear system of a low top shoe.
Figure 28B:
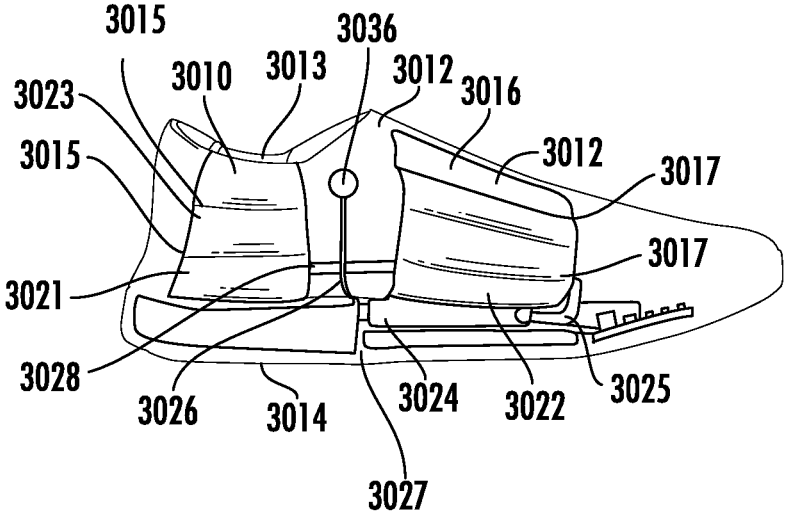
FIG. 28B is a schematic diagram of the extensor system used in FIG. 28A.

FIGS. 28A and 28B are schematic diagrams of adjustable footwear system 3000 in accordance with the teachings of the present invention. Adjustable footwear system 3000 is shown in an un-activated state. Footwear 3001 includes upper 3012. Preferably, upper 3012 is formed of an elastic material. For example, upper 3012 can be formed of one or more materials having elastic properties. Suitable materials include, but are not limited to, Lycra, elastic, spandex, neoprene, or PVC. Upper 3012 can also include one or more materials which are more rigid. Suitable rigid materials include, but are not limited to, plastic, polyurethane and polypropylene. The rigid material can provide support of upper 3012 or decoration. Cavity 3013 is formed between upper 3012 and sole 3014.

Adjustable footwear system 3000 includes extensor system 3020. Extensor system 3020 can be activated by pressure activation device 3330. Extensor system 3020 includes a one or more heel extensors 3021 and one or more upper extensors 3022. In one embodiment, heel extensors 3021 can be formed individually. Alternatively, heel extensors 3021 can be formed of plenum 3023 which is divided by one or more baffles 3015. In one embodiment, upper extensors 3022 can be formed individually. Alternatively, upper extensors 3022 can be formed of plenum 3016 which is divided by one or more baffles 3017.

Hydraulic path 3025 connects one or more upper extensors 3022 to fluid reservoir 3024. Hydraulic path 3026 connects fluid reservoir 3024 to pressure activation device 3030. Fluid reservoir 3024 can be positioned within cavity 3027 between bottom sole 3028 and insole 3014. Hydraulic path 3028 connects one or more heel extensors 3021 to one or more upper extensors 3022. One or more flexors 3040 can be positioned at top 3042 of upper 3012.

Pressure activation device 3030 controls pressure within one or more heel extensors 3021 and one or more upper extensors 3022. Pressure activation device 3030 includes pressure button actuator 3036. In the un-activated state shown in zero pressure is used in extensor system 3020. One or more heel extensors 3021 and one or more upper extensors 3022 in the un-activated state are substantially flat within upper 3012.

Pressure activation device 3030 can be hydraulic and use fluids or air with pressure button actuator 3036 to manually increase the pressure in extensor system 3020.

Activation of pressure button actuator 3036 increases pressure in extensor system 3020 to expand one or more heel extensors 3021 and one or more upper extensors 3022 to create a larger cavity 3013 for easy insertion of a foot into upper 3012. In the activated state, one or more heel extensors 3021 and one or more upper extensors 3022 are no longer flat.

Figure 29A:
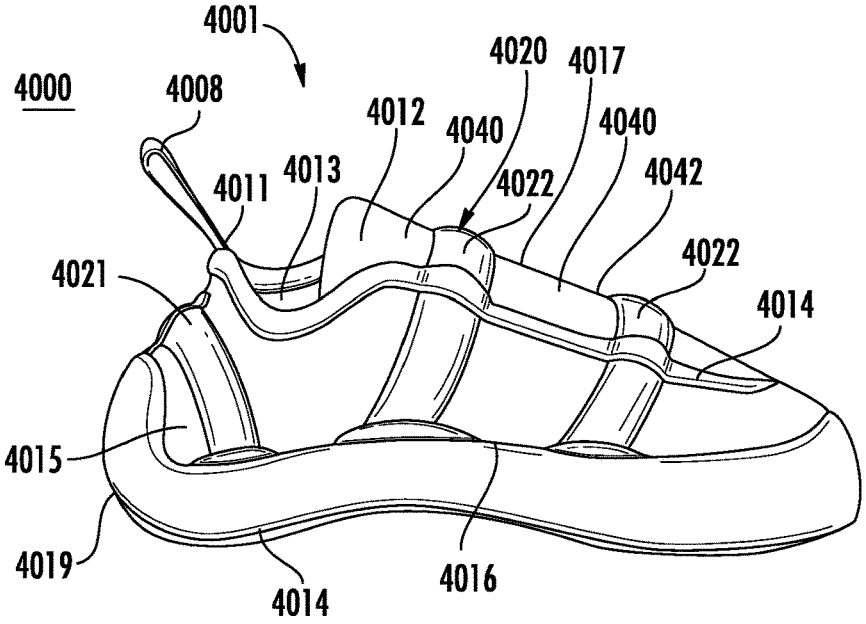
FIG. 29A is a schematic diagram of an extensor system used in an adjustable footwear system of a climbing shoe.
Figure 29B:
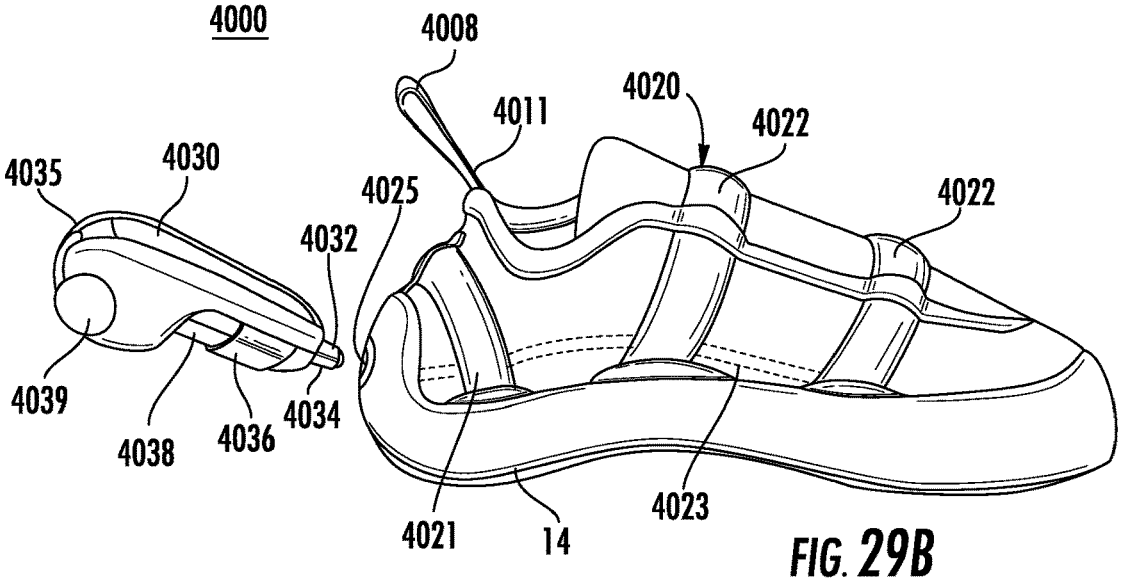
FIG. 29B is a schematic diagram of the extensor system used in FIG. 29A.

FIGS. 29A and 29B are schematic diagrams of adjustable footwear system 4000 in accordance with the teachings of the present invention. Adjustable footwear system 4000 is shown in an un-activated state. Footwear 4001 includes upper 4012. Preferably, upper 4012 is formed of an elastic material. For example, upper 4012 can be formed of one or more materials having elastic properties. Suitable materials include, but are not limited to, Lycra, elastic, spandex, neoprene, or PVC. Upper 4012 can also include one or more materials which are more rigid. Suitable rigid materials include, but are not limited to, plastic, polyurethane and polypropylene. The rigid material can provide support of upper 4012 or decoration. Cavity 4013 is formed between upper 4012 and sole 4014. Heel portion 4015 is positioned at rear 4016 of footwear 4001. Strap 4008 can be positioned at rear of 4011 of cavity 4013.

Adjustable footwear system 4019 includes extensor system 4020. Extensor system 4020 can be activated by pressure activation device 4030. Extensor system 4020 includes a one or more heel extensors 4021 positioned at heel portion 4015. One or more upper extensors 4022 are positioned at upper portion 4012. One or more heel extensors 4021 can extend radially around heel portion from edge 4016 to an opposite edge 4017 on the opposite side of footwear 4001. One or more upper extensors 4022 can extend radially around upper portion 4012 from edge 4016 to an opposite edge 4017 on the opposite side of footwear 4001. Hydraulic path 4023 connects one or more heel extensors 4021 and one or more upper extensors 4022 to outlet 4025. Inlet 4032 of pressure activation device 4030 can be connected to outlet 4025. Hydraulic path 4034 connects fluid reservoir 4036 to inlet 4032. Fluid reservoir 4036 can be positioned within housing 4035. Pressure activation device 4030 includes pressure button actuator 4036. Hydraulic path 4038 connects fluid reservoir 4036 to pressure button actuator 4039. One or more flexors 4040 can be positioned at top 4042 of upper 4012.

Pressure activation device 4030 controls pressure within one or more heel extensors 4021 and one or more upper extensors 4022. In the un-activated state shown in zero pressure is used in extensor system 4020. One or more heel extensors 4021 and one or more upper extensors 4022 in the un-activated state are substantially flat within upper 4012.

Pressure button activation device 4030 can be pumped to activate fluid reservoir 4036 to manually increase the pressure in extensor system 4020. Activation of pressure button actuator 4036 increases pressure in extensor system 4020 to expand one or more heel extensors 4021 and one or more upper extensors 4022 to create a larger cavity 4013 for easy insertion of a foot into upper 4012. In the activated state one or more heel extensors 4021 and one or more upper extensors 4022 are no longer flat.

It is to be understood that the above-described embodiments are illustrative of only a few of the many possible specific embodiments, which can represent applications of the principles of the invention. Numerous and varied other arrangements can be readily devised in accordance with these principles by those skilled in the art without departing from the spirit and scope of the invention.

What is claimed is:

1. An adjustable article loosening system comprising: footwear including an upper and an insole, the upper is formed of an elastic material; a cavity positioned between the upper and the insole; an extensor system embedded in the upper, the extensor system including one or more extensors arranged in one or more groups; and one or more activation devices for activating the one or more extensors, the one or more activation devices are activated for adjusting the extensor system to increase pressure in the extensor system to expand the one or more extensors in a horizontal and vertical direction in order to extend the elastic material and increase the size of the cavity to allow insertion and removal of a foot in the cavity or the one or more activation devices are activated for adjusting the extensor system for decreasing pressure in the extensor system to decrease the size of the cavity to allow the elastic material to apply pressure against a foot received in the cavity.

2. The adjustable article loosening system of claim 1 wherein when the extensor system is activated the extensor system provides a rigid infrastructure.

3. The adjustable article loosening system of claim 1 wherein the extensor system is pressure activated, and the activation device is a pump.

* * * * *